US006381568B1

(12) United States Patent
Supplee et al.

(10) Patent No.: US 6,381,568 B1
(45) Date of Patent: Apr. 30, 2002

(54) METHOD OF TRANSMITTING SPEECH USING DISCONTINUOUS TRANSMISSION AND COMFORT NOISE

(75) Inventors: Lynn Michele Supplee, Crownsville; Richard A. Dean; Mary A Kohler, both of Columbia, all of MD (US)

(73) Assignee: The United States of America as represented by the National Security Agency, Washington, DC (US)

( * ) Notice: Subject to any disclaimer, the term of this patent is extended or adjusted under 35 U.S.C. 154(b) by 0 days.

(21) Appl. No.: 09/305,325

(22) Filed: May 5, 1999

(51) Int. Cl.[7] ..... G10L 11/06

(52) U.S. Cl. ..... 704/210; 704/233

(58) Field of Search ..... 704/210, 215, 704/219, 200, 207, 200.1, 231, 233

(56) References Cited

U.S. PATENT DOCUMENTS

| | | | | | |
|---|---|---|---|---|---|
| 3,832,491 | A | | 8/1974 | Sciulli et al. | |
| 4,008,375 | A | | 2/1977 | Lanier | |
| 4,351,983 | A | | 9/1982 | Crouse et al. | |
| 4,672,669 | A | | 6/1987 | Desblache et al. | |
| 4,696,039 | A | * | 9/1987 | Doddington | 704/231 |
| 5,255,340 | A | | 10/1993 | Arnaud et al. | |
| 5,276,765 | A | | 1/1994 | Freeman et al. | |
| 5,459,814 | A | | 10/1995 | Gupta et al. | |
| 5,533,118 | A | | 7/1996 | Cesaro et al. | |
| 5,598,466 | A | | 1/1997 | Graumann | |
| 5,612,955 | A | | 3/1997 | Fernandes et al. | |
| 5,619,565 | A | | 4/1997 | Cesaro et al. | |
| 5,619,566 | A | | 4/1997 | Fogel | |
| 5,649,055 | A | | 7/1997 | Gupta et al. | |
| 5,722,086 | A | * | 2/1998 | Teitler et al. | 455/561 |
| 5,732,141 | A | | 3/1998 | Chaoui et al. | |
| 5,737,407 | A | | 4/1998 | Graumann | |
| 5,749,067 | A | | 5/1998 | Barrett | |
| 5,812,965 | A | | 9/1998 | Massaloux | |
| 5,835,889 | A | * | 11/1998 | Kapanen | 704/215 |
| 5,867,574 | A | | 2/1999 | Eryiimaz | |
| 5,890,109 | A | * | 3/1999 | Walker et al. | 704/215 |
| 5,978,756 | A | * | 11/1999 | Walker et al. | 704/210 |
| 6,049,765 | A | * | 4/2000 | Iyengar et al. | 704/201 |
| 6,055,497 | A | * | 4/2000 | Hallkvist et al. | 704/228 |
| 6,097,772 | A | * | 8/2000 | Johnson et al. | 375/346 |
| 6,173,257 | B1 | * | 1/2001 | Gao | 704/220 |
| 6,188,980 | B1 | * | 2/2001 | Thyssen | 704/230 |
| 6,205,476 | B1 | * | 3/2001 | Hayes, Jr. | 709/220 |

* cited by examiner

*Primary Examiner*—Richemond Dorvil
(74) *Attorney, Agent, or Firm*—Robert D. Morelli

(57) ABSTRACT

Speech transmission method by initializing silence, transmit, and blank-period counters; receiving frame; determining frame is speech; if transmit counter is zero and blank-period counter is less than x then discard frame, increment blank-period counter, and return to second step; if transmit counter is zero, blank-period counter greater than x−1, and frame not speech then discard frame, increment blank-period counter, and return to second step; if transmit counter is zero, blank-period counter greater than x−1, and frame is speech then set transmit counter to one, set blank-period counter to zero, set silence counter to zero, encode frame, transmit encoded frame, and return to second step; if transmit counter is one, frame not speech, and silence counter less than y then encode frame, transmit encoded frame, increment silence counter, and return to second step; if transmit counter is one, frame not speech, and silence counter greater than y+z−2 then set transmit counter to zero, discard frame, encode comfort noise, transmit encoded comfort noise, increment silence counter, and return to second step; if transmit counter is one, frame not speech, and silence counter greater than y−1 then discard frame, encode comfort noise, transmit encoded comfort noise, increment silence counter, and return to second step; and if transmit counter is one, frame is speech, and silence counter less than y+z then encode frame, transmit encoded frame, set silence counter to zero, and return to second step.

12 Claims, 6 Drawing Sheets

| | | | | | | | |
|---|---|---|---|---|---|---|---|
| F1 | F2 | F3 | F4 | F5 | F6 | F7 | F8 |

FIG. 2

METHOD OF TRANSMITTING SPEECH USING DISCONTINUOUS TRANSMISSION AND COMFORT NOISE

FIELD OF THE INVENTION

The present invention relates, in general, to data processing and, in particular, to speech signal processing.

BACKGROUND OF THE INVENTION

Systems for transmitting speech to a receiver often digitize the speech, divide the digitized speech into frames, encode each frame using a particular voice encoder, or vocoder algorithm, and transmit the frames to a receiver.

Some of the problems encountered by these systems include unnecessary complexity, recognizing background noise as speech when no speech is present, transmitting too many frames that do not contain speech, sending frames encoded using a format other than the chosen vocoder, and so on.

Some speech transmission systems are unnecessarily complex. Such systems tend to be more expensive than simpler systems because of the additional software required to perform a complex function. Also, a complex system may be too slow for a particular purpose because of the additional time required to complete a complex function.

Some speech systems set thresholds for background noise that are based on a theoretical model of noise. Such systems are susceptible to erroneous determinations that speech is present in a frame when it is not because of unanticipated changes in the actual background noise from transmission to transmission. Also, some systems do not adjust the background noise thresholds once set or do not adjust the thresholds often enough to keep pace with a rapidly changing noise background. These same points apply to how systems set the threshold for determining whether or not speech is present within a frame.

Speech transmission systems that send too many frames that do not contain speech waste bandwidth that could have been used to transmit frames that do contain speech and run the risk that the receiver will mistakenly conclude that the transmission is over for lack of any voice activity.

Some speech transmission systems send additional frames (e.g., comfort noise) that are not encoded using the chosen vocoder but are sent using special frames. Using special frames add complexity to the receiver because the receiver must be able to recognize these special frames. Also, special frames may cause bothersome noise in the receiver since the special frames where not encoded using the chosen vocoder algorithm.

U.S. Pat. No. 3,832,491, entitled "DIGITAL VOICE SWITCH WITH AN ADAPTIVE DIGITALLY-CONTROLLED THRESHOLD," discloses a voice switch that adjusts the threshold for determining the presence of speech that is adjusted only after a theoretically optimum threshold is exceeded 1,220 times and adjusts a minimum speech threshold based on noise. U.S. Pat. No. 3,832,491 does not perform the steps of the present invention and does not adjust the speech threshold in the same manner, or as often, as does the present invention. U.S. Pat. No. 3,832,491 is hereby incorporated by reference into the specification of the present invention.

U.S. Pat. No. 4,008,375, entitled "DIGITAL VOICE SWITCH FOR SINGLE OR MULTIPLE CHANNEL APPLICATIONS," discloses a voice switch that adjusts the threshold for determining the presence of speech based on a statistical analysis of whether or not the number of times the speech threshold is exceeded is uniform or non-uniform. U.S. Pat. No. 4,008,375 does not perform the steps of the present invention and does not adjust the speech threshold as often as does the present invention. U.S. Pat. No. 4,008,375 is hereby incorporated by reference into the specification of the present invention.

U.S. Pat. Nos. 5,612,955, entitled "MOBILE RADIO WITH TRANSMIT COMMAND CONTROL AND MOBILE RADIO SYSTEM"; U.S. Pat. No. 5,812,965, entitled "PROCESS AND DEVICE FOR CREATING COMFORT NOISE IN A DIGITAL SPEECH TRANSMISSION"; and U.S. Pat. No. 5,835,889, entitled "METHOD AND APPARATUS FOR DETECTING HANGOVER PERIODS IN A TDMA WIRELESS COMMUNICATION SYSTEM USING DISCONTINUOUS TRANSMISSION" each transmit a special silence descriptor (SID) frame when silence is encountered and the transmission of speech is discontinued. This special frame may cause bothersome noise at the receiver whereas the method of the present invention does not. U.S. Pat. Nos. 5,612,955; 5,812,965; and 5,835,889 are hereby incorporated by reference into the specification of the present invention.

U.S. Pat. No. 4,351,983, entitled "SPEECH DETECTOR WITH VARIABLE THRESHOLD," discloses a device for and method of detecting speech by adjusting the threshold for determining speech, but does not do so as does the present invention. Also, U.S. Pat. No. 4,351,983 does not employ comfort noise and discontinuous transmission as does the present invention. U.S. Pat. No. 4,351,983 is hereby incorporated by reference into the specification of the present invention.

U.S. Pat. No. 4,672,669, entitled "VOICE ACTIVITY DETECTION PROCESS AND MEANS FOR IMPLEMENTING SAID PROCESS," discloses advice for and method of detecting voice activity by comparing the energy of a signal to a threshold. The signal is determined to be voice if its power is above the threshold. If its power is below the threshold then the rate of change of the spectral parameters is tested. U.S. Pat. No. 4,672,669 does not employ, comfort noise of discontinuous transmission as does the present invention. U.S. Pat. No. 4,672,669 is hereby incorporated by reference into the specification of the present invention.

U.S. Pat. No. 5,255,340, entitled "METHOD FOR DETECTING VOICE PRESENCE ON A COMMUNICATION LINE," discloses a method of detecting voice activity by determining the stationary or non-stationary state of a block of the signal and comparing the result to the results of the last M blocks and does not employ the steps of the present method. U.S. Pat. No. 5,255,340 is hereby incorporated by reference into the specification of the present invention.

U.S. Pat. No. 5,276,765, entitled "VOICE ACTIVITY DETECTION," discloses a device for and a method of detecting voice activity by performing an autocorrelation on weighted and combined coefficients of the input signal to provide a measure that depends on the power of the signal. The measure is then compared against a variable threshold to determine voice activity. However, the speech threshold is not adjusted during speech periods as in the present invention. U.S. Pat. No. 5,276,765 is hereby incorporated by reference into the specification of the present invention.

U.S. Pat. Nos. 5,459,814 and 5,649,055, both entitled "VOICE ACTIVITY DETECTOR FOR SPEECH SIGNALS IN VARIABLE BACKGROUND NOISE," discloses a device for and method of detecting voice activity by measuring short term time domain characteristics of the input signal, including the average,signal level and the absolute value of any change in average signal level and not the steps of the present method. U.S. Pat. Nos. 5,459,814 and 5,649,055 are hereby incorporated by reference into the specification of the present invention.

U.S. Pat. Nos. 5,533,118 and 5,619,565, both entitled "VOICE ACTIVITY DETECTION METHOD AND APPARATUS USING THE SAME," discloses a device for and method of distinguishing voice activity from two tones by dividing the square of the maximum value of the received signal by its energy and comparing this ratio to three different thresholds and not the steps of the present method. U.S. Pat. Nos. 5,533,118 and 5,619,565 are hereby incorporated by reference into the specification of the present invention.

U.S. Pat. Nos. 5,598,466 and 5,737,407, both entitled "VOICE ACTIVITY DETECTOR FOR HALF-DUPLEX AUDIO COMMUNICATION SYSTEM," discloses a device for and method of detecting voice activity by determining an average peak value, a standard deviation, updating a power density function, and detecting voice activity if the average peak value exceeds the power density function and not the steps of the present method. U.S. Pat. Nos. 5,598,466 and 5,737,407 are hereby incorporated by reference into the specification of the present invention.

U.S. Pat. No. 5,619,566, entitled "VOICE ACTIVITY DETECTOR FOR AN ECHO SUPPRESSOR AND AN ECHO SUPPRESSOR," discloses a device for detecting voice activity that includes a whitening filter, a means for measuring energy, and using the energy level to determine the presence of voice activity and not the steps of the present method. U.S. Pat. No. 5,619,566 is hereby incorporated by reference into the specification of the present invention.

U.S. Pat. No. 5,732,141, entitled "DETECTING VOICE ACTIVITY," discloses a device for and method of detecting voice activity by computing the autocorrelation coefficients of a signal, identifying a first autocorrelation vector, identifying a second autocorrelation vector, subtracting the first autocorrelation vector from the second autocorrelation vector, and computing a norm of the differentiation vector which indicates whether or not voice activity is present and not the steps of the present method. U.S. Pat. No. 5,732,141 is hereby incorporated by reference into the specification of the present invention.

U.S. Pat. No. 5,749,067, entitled "VOICE ACTIVITY DETECTOR," discloses a device for and method of detecting voice activity by comparing the spectrum of the a signal to a noise estimate, updating the noise estimate, computing a linear predictive coding prediction gain, and suppressing updating the noise estimate if the gain exceeds a threshold and not the steps of the present method. U.S. Pat. No. 5,749,067 is hereby incorporated by reference into the specification of the present invention.

U.S. Pat. No. 5,867,574, entitled "VOICE ACTIVITY DETECTION SYSTEM AND METHOD," discloses a device for and method of detecting voice activity by computing an energy term based on an integral of the absolute value of a derivative of a speech signal, computing a ratio of the energy to a noise level, and comparing the ratio to a voice activity threshold and not the steps of the present method. U.S. Pat. No. 5,867,574 is hereby incorporated by reference into the specification of the present invention.

SUMMARY OF THE INVENTION.

It is an object of the present invention to transmit encoded frames of digitized speech.

It is another object of the present invention to. transmit encoded comfort noise after a user-definable number of frames have been detected that do not contain speech.

It is another object of the present invention to discontinue transmission after a user-definable number of frames are detected that do not contain speech.

It is another object of the present invention to resume transmission after transmission has been discontinued upon the detection of a frame containing speech.

It is another object of the present invention to adjust the threshold for determining the presence of speech based on the energy of the frame on a frame by frame basis.

It is another object of the present invention to adjust a minimum energy threshold on a frame by frame basis.

It is another object of the present invention to adjust a maximum energy threshold on a frame by frame basis.

The present invention is a method of transmitting speech.

The first step is setting a silence counter to zero.

The second step is setting a transmit counter to one.

The third step is setting a blank period counter to zero.

The fourth step is receiving a frame of digitized information that may or may not contain speech.

The fifth step is determining if the frame contains speech.

The sixth step is checking if the transmit counter is equal to zero and the blank period counter is less than x, where x is a positive integer.

The seventh step is checking if the transmit counter is equal to zero, the blank period counter is greater than x−1, and the frame does not contain speech.

The eighth step is checking if the transmit counter is equal to zero, the blank period counter is greater than x−1, and the frame contains speech.

The ninth step is checking if the transmit counter is equal to one, the frame does not contain speech, and the silence counter is less than y.

The tenth step is checking if the transmit counter is equal to one, the frame does not contain speech, and the silence counter is greater than y+z−2, where y and z are both positive integers.

The eleventh step is checking if the transmit counter is equal to one, the frame does not contain speech and the silence counter is greater than y−1.

The twelfth, and last, step is checking if the transmit counter is equal to one, the frame contains speech and the silence counter is less than y+z.

In the preferred embodiment, the energy of a frame is calculated using the following equation.

$$E=\sqrt{(A^{H\times A})/(\text{FrameSize})}$$

A minimum energy threshold is set.

A maximum energy threshold is set.

A speech threshold is set as T=(0.07×maximum energy threshold)+(K×minimum energy threshold), where K is a user-definable value.

The energy of the frame is compared to the speech threshold.

If the energy of the frame is less than the speech threshold then concluding that no speech is contained within the frame, otherwise concluding that speech is contained within the frame.

Increasing the minimum energy threshold by a first user-definable percentage.

Additionally, the energy of the frame may be checked to see if it is less than the minimum energy threshold. If so, set the first user-definable percentage to what the first user-definable percentage was set to initially. Also, check if the energy of the frame is greater than the minimum energy threshold. If so then increase the first user-definable percentage by a second user-definable percentage.

In an alternate embodiment, the maximum energy threshold may be modified in a similar, but complementary, fashion as was the minimum energy threshold.

BRIEF DESCRIPTION OF THE DRAWINGS

FIG. 2 is an illustration of one possible sequence of frames;

DETAILED DESCRIPTION

Figure 1:
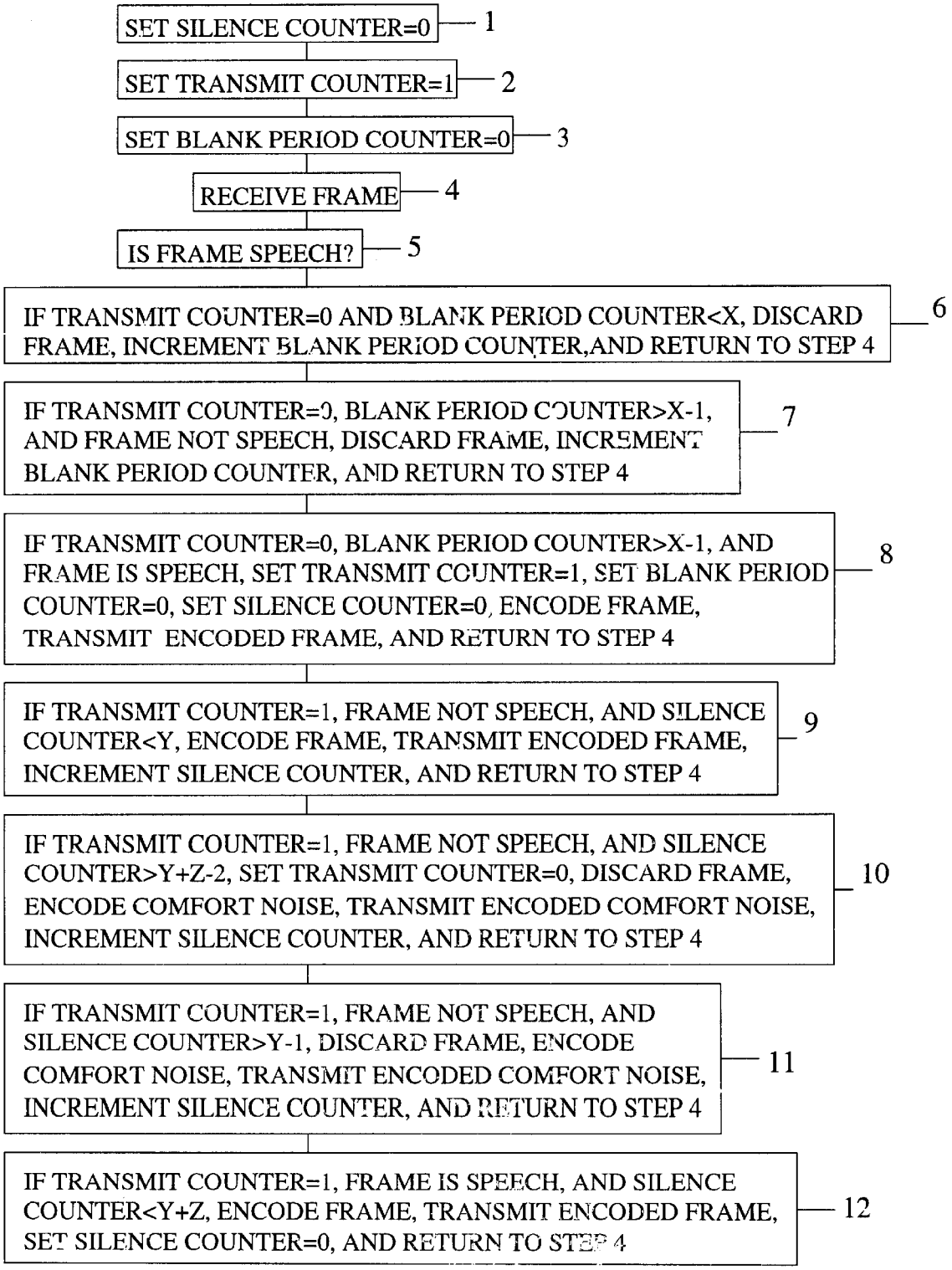
FIG. 1 is a list of steps of the present method.

The present invention is a method of transmitting speech. FIG. 1 is a list of steps of the present method.

The first step 1 is setting a silence counter to zero. The silence counter is used to count the number of frames that do not contain speech (i.e., contain silence). Each frame is digitized.

The second step 2 is setting a transmit counter to one. The transmit counter is used as a flag to indicate whether or not an encoded frame may be transmitted. A setting of lone indicates that an encoded frame may be transmitted while a setting of zero indicates that discontinuous transmission mode has been entered and an encoded frame may not be transmitted.

The third step 3 is setting a blank period counter to zero. The blank period counter is used to count how many frames were not transmitted during the minimum blanking period. After a user-definable number of frames that do not contain speech have been encoded and transmitted, the next frame that does not contain speech is not encoded or transmitted. Bandwidth would be wasted by transmitting a frame that does not contain speech (i.e., silence). Therefore, discontinuous transmission mode is entered to prevent the transmission of silence frames after a certain number of silence frames are encountered. Once in discontinuous transmission model, transmission is not allowed. This is called the blanking period. Once the blanking period is entered, the present invention stays there for a minimum period. The minimum blanking period is defined as the period when a user-definable number of frames are not transmitted (i.e., discarded). The frames discarded during the minimum blanking period are discarded whether or not they contain speech. There is no maximum blanking period. The present invention remains in discontinuous transmission mode, or the blanking period, after the minimum blanking period for as long as the frames received after the minimum blanking period do not contain speech.

The fourth step 4 is receiving a frame of digitized information that may or may not contain speech.

The fifth step 5 is determining if the frame contains speech. The details of how the present method determines whether or not a frame contains speech is described in FIG. 3 below.

The sixth step 6 in FIG. 1 is checking if the transmit counter is equal to zero and the blank period counter is less than x, where x is a positive integer. If so then discarding the frame (whether it contains speech or not), incrementing the blank period counter by one, and returning to step four 4. The sixth step 6 is a test to see if discontinuous transmission mode has been entered and whether or not a user-definable minimum number-of frames have been discarded while in discontinuous transmission mode. Discarding frames may be referred to as blanking. In the preferred embodiment, the minimum blanking period (i.e., x) is two. However, any other suitable value may be used for x. Therefore, in the preferred embodiment, two frames are discarded once discontinuous transmission mode is entered, whether or not any of these two frames contain speech.

The seventh step 7 is checking if the transmit counter is equal to zero, the blank period counter is greater than x−1, and the frame does not contain speech. If so then discarding the frame, incrementing the blank period counter by one, and returning to the fourth step 4. The seventh step 7 is a test to see if a frame does not contain speech after discontinuous transmission mode has been entered and the minimum blanking period is over (i.e., x frames were discarded). If a frame does not contain speech while in discontinuous transmission mode and x frames were discarded then the present method stays in discontinuous transmission mode and discards the next frame encountered if it does not contain speech.

The eighth step 8 is checking if the transmit counter is equal to zero, the, blank period counter is greater than x−1, and the frame contains speech. If so then setting the transmit counter to one, setting the blank period counter equal to zero, setting the silence counter equal to zero, encoding the frame, transmitting the encoded frame, and returning to the fourth step 4. The eighth step 8 is a test to see if a frame of speech is encountered while in discontinuous transmission mode and after the minimum blanking period has been met. If so then discontinuous transmission mode is exited and the counters are reset to their initial settings.

The ninth step 9 is checking if the transmit counter is equal to one, the frame does not contain speech, and the silence counter is less than y. If so then encoding the frame, transmitting the encoded frame, incrementing the silence counter by one, and returning to the fourth step 4. The ninth step 9 is a test to see if less than a certain number of consecutive frames (i.e., y) are encountered that do not contain speech. In the preferred embodiment, y is equal to three, but any suitable number for y is possible. In the present method, y consecutive frames may not contain. speech and will still be encoded with a vocoder and transmitted to a receiver. The value y is the grace period before replacing a silence frame with a comfort noise frame. In the preferred embodiment, Mixed Excitation Linear Prediction (MELP) is the preferred vocoder. However, any other suitable vocoder may be used.

The tenth step 10 is checking if the transmit counter is equal to one, the frame does not contain speech, and the silence counter is greater than y+z−2, where y and z are both positive integers. If so then setting the transmit counter to zero, discarding the frame, encoding a frame containing comfort noise, transmitting the encoded frame containing comfort noise, incrementing the silence counter by one, and returning to the fourth step 4. The tenth step 10 is a test to see if discontinuous transmission mode should be entered. If a user-definable number of consecutive frames (i.e., y+z) were encountered that did not contain speech then discontinuous transmission mode is entered. Once discontinuous transmission mode is entered, silence frames received after the minimum blanking period are not transmitted but discarded. As described in a previous step, once discontinuous transmission mode is entered, a minimum number of frames are discarded before frames containing speech may be transmitted again. In the preferred embodiment, y is equal to three and z is equal to two. However, any other suitable values may be used for y and z.

The eleventh step 11 is checking if the transmit counter is equal to one, the frame does not contain speech and the silence counter is greater than y−1. If so then discarding the frame, encoding a frame containing comfort noise, transmitting the encoded frame containing comfort noise, incrementing the silence counter by one, and returning to the fourth step 4. The eleventh step 11 is a test to see if a frame that does not contain speech is encountered after y consecutive frames were encountered that also do not contain speech. If this happened then the present invention does not encode the frame but instead encodes a frame of comfort noise using the vocoder and transmitting that to the receiver. This guards against the user on the receiving end having to listen to abrupt changes in speech and noise levels between frames that are transmitted and then nothing (when frames are not transmitted). Users prefer to have the background noise continue during the periods when nothing is being transmitted. This present method provides the receiver with a means to generate background noise and advance notice that discontinuous mode may be entered. Note that the comfort noise in the present invention is encoded as a frame of vocoder speech rather than using a special frame as does the prior art. By encoding comfort noise with the vocoder and sending it to the receiver, the receiver does not have to have any extra capability for recognizing a special frame. This reduces the complexity of the receiver. Also, by encoding comfort noise with the vocoder, the receiver is able to process the frame more easily and with expected results (i.e., just the comfort noise is heard by the receiver). In the methods of the prior art, a special frame is processed in a manner that results in the generation of bothersome noise that may cause the receiver discomfort. Anyone who is required to listen to a receiver for any length of time would greatly appreciate every effort to reduce annoying, and loud, noise that may be harmful, especially if they are trying to listen hard to low volume speech. In the preferred embodiment two, or z, frames of comfort noise are transmitted if two consecutive frames of silence are encountered after three, or y, consecutive frames of silence are encountered.

The twelfth, and last, step 12 is checking if the transmit counter is equal to one, the frame contains speech and the silence counter is less than y+z. If so then encoding the frame, transmitting the encoded frame, setting the silence counter to zero, and returning to the fourth step 4. The twelfth step 12 is encoding and transmitting a speech frame anytime such a frame is encountered before y+z consecutive frames of silence are encountered (i.e., before discontinuous transmission mode is entered). Therefore, a speech frame will be encoded and transmitted anytime within the grace period y for entering the comfort noise period z and anytime within the comfort noise period z before entering the discontinuous transmission mode period x. If a speech frame is encountered within the periods y or z then the counters are reset that count consecutive frames of silence and how many frames of encoded comfort noise were sent.

FIG. 2 is an illustration of one possible sequence of frames. FIG. 2 shows eight consecutive frames of silence. In the preferred embodiment, y=3, z=2, and x=2. Initially, the silence counter is set to zero, the transmit counter is set to one, and the blank period counter is set to zero.

The first frame encountered is silence. Therefore, it is encoded and transmitted. Now, the silence counter is set to one, the transmit counter is still set at one, and the blank period counter is still set at zero.

The second frame encountered is silence. Therefore, it is encoded and transmitted. Now, the silence counter is set to two, the transmit counter is still set at one, and the blank period counter is still set at zero.

The third frame encountered is silence. Therefore, it is encoded and transmitted. Now, the silence counter is set to three, the transmit counter is still set at one, and the blank period counter is still set at zero.

The fourth frame encountered is silence. Therefore, it is replaced with comfort noise. The comfort noise is encoded and transmitted. Now, the silence counter is set to four, the transmit counter is still set at one, and the blank period counter is still set at zero. Note that comfort noise mode has been entered. If any of the first three frames contained speech, the silence counter would have been reset and the comfort noise mode would not have been entered.

The fifth frame encountered is silence. Therefore, it is replaced with comfort noise. The comfort noise is encoded and transmitted. Now, the silence counter is set to five; the transmit counter is set to zero, and the blank period counter is still set at zero. If the fifth frame would have contained speech then comfort noise mode would have been exited, the silence counter would have been reset, the fifth frame would have been encoded, and the fifth frame would have be en transmitted.

The sixth frame is encountered. Since discontinuous transmission mode has been entered (i.e., the transmit counter was set to zero), the sixth frame is discarded (whether it contains speech or not), and the blank period counter is set to one.

The seventh frame is encountered. Since the system is in discontinuous transmission mode and the minimum blanking period has not been exceeded, the seventh frame is discarded (whether it contains speech or not). Now, the blank period counter is set to two (i.e., the extent of the mandatory blanking period in the preferred embodiment). Therefore, the discontinuous transmission mode may be exited as soon as a frame containing speech is encountered. However, the present method will remain in discontinuous transmission mode for as long as silence frames are received.

The eighth frame encountered is silence. So, it is discarded and the blank period counter is set to three. If the eighth frame contained speech then the silence counter would have been reset to zero, the transmit counter would have been reset to one, the blank period counter would have been reset to zero, the frame would have been encoded, the encoded frame would have been transmitted, and the next frame would have been processed.

Figure 3:
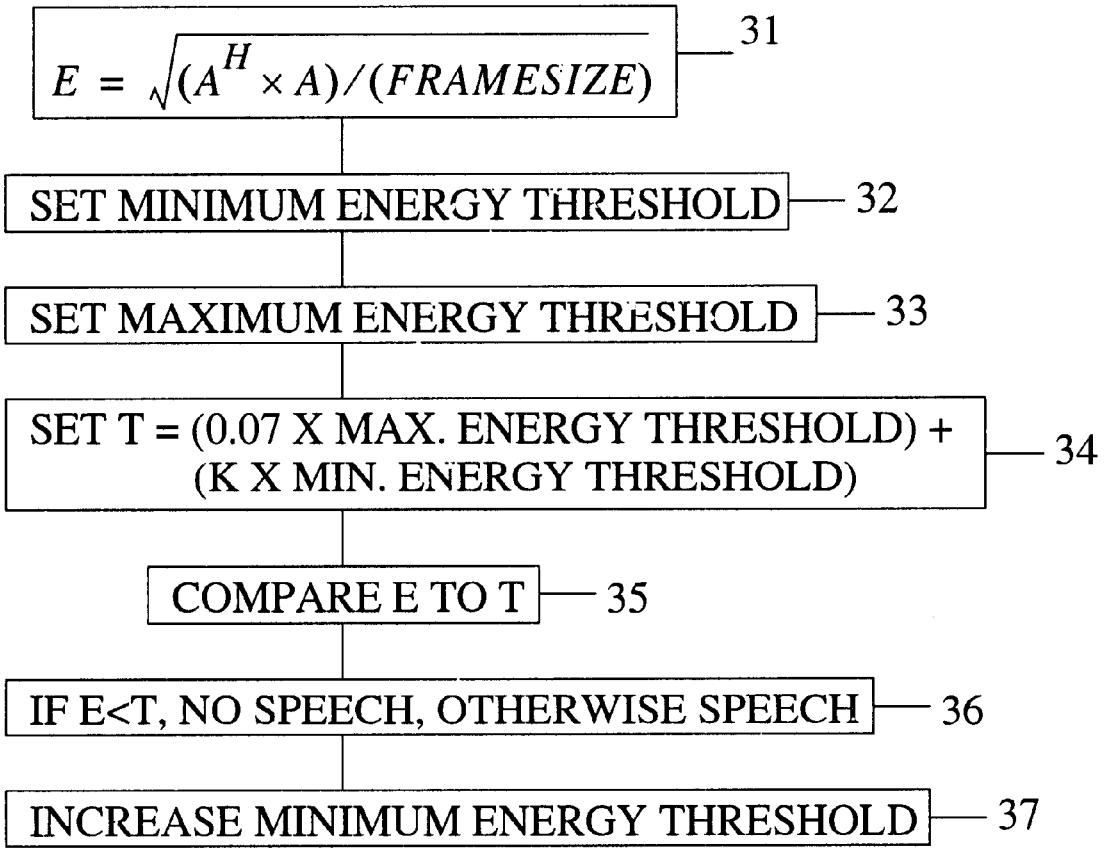
FIG. 3 is a list of steps for determining whether or not a frame contains speech.

FIG. 3 lists the step for determining if a frame contains speech.

The first step 31 is calculating an energy of the frame. In the preferred embodiment, the following equation is used, but any other suitable energy equation may be used.

$$E=\sqrt{(A^{H\times A})/(\text{FrameSize})}$$

"The equation for E is a root-mean-square (RMS) calculation, where A is a vector of one frame of input data. $A^H$ is a complex conjugate transpose of A, and FrameSize is the number of samples per MELP frame."

The second step 32 is setting a minimum energy threshold. In the preferred embodiment, the minimum energy threshold is initially set to the energy level of the first frame encountered. Thereafter, it is replaced with the energy of a subsequent frame that is lower than the present value of the minimum energy threshold.

The third step 33 is setting a maximum energy threshold. In the preferred embodiment, the maximum energy threshold is initially set to the energy level of the first frame encountered. Thereafter, it is replaced with the energy of a subsequent frame that is higher than the present value of the maximum energy threshold.

The fourth step 34 is setting a speech threshold as T=(0.07×maximum energy threshold) +(K×minimum energy threshold), where K is a user-definable value. A frame having an energy level higher than the speech threshold will be determined to contain speech while a frame having an energy level lower than the speech threshold will be determined to not contain speech.

The fifth step 35 is comparing the energy of the frame to the speech threshold.

The sixth step 36 is checking if the energy of the frame is less than the speech threshold. If so then concluding that no speech is contained within the frame, otherwise concluding that speech is contained within the frame.

Figure 4:
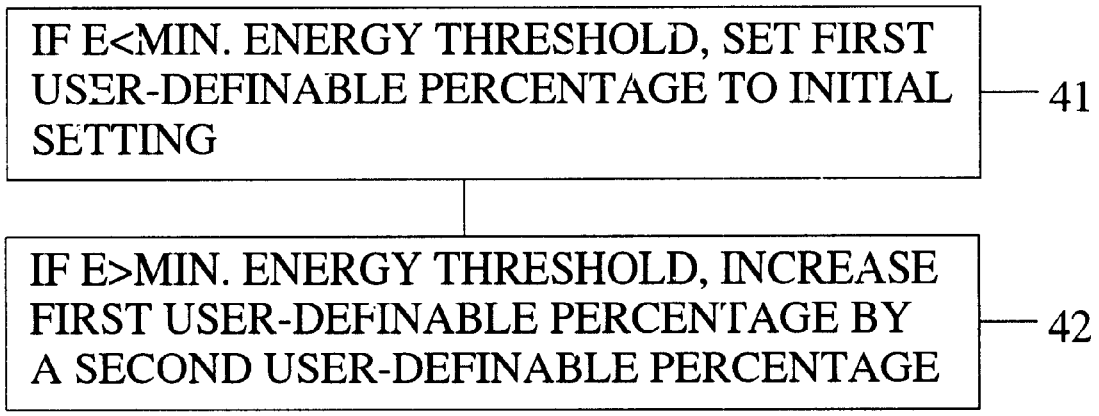
FIG. 4 is a list of steps for adjusting the minimum energy threshold.

The seventh, and last, step 37 is increasing the minimum energy thres hold by a first user-definable percentage. This is done to compensate for a frame of extremely low energy level that would skew the speech threshold. If such a low energy level is encountered, its effects would only linger for as long as it took for the user-definable percentage to raise the minimum energy level back to where it should be. In the preferred embodiment, the first user-definable percentage is one percent. However, any other suitable percentage may be used FIG. 4 is a lists of steps that may be done in addition to the steps in FIG. 3 in order to compensate for background noise when determining if a frame contains speech.

The first additional step 41 is to check if the energy of the frame is less than the minimum energy threshold. If so then setting the first user-definable percentage to what the first user-definable percentage was set to initially.

The second additional step 42 is checking if the energy of the frame is greater than the minimum energy threshold. If so then increasing the first user-definable percentage by a second user-definable percentage. In the preferred embodiment, the second user-definable percentage is one-hundredth of a percent. However, any other suitable percentage increase may be used.

Figure 5:
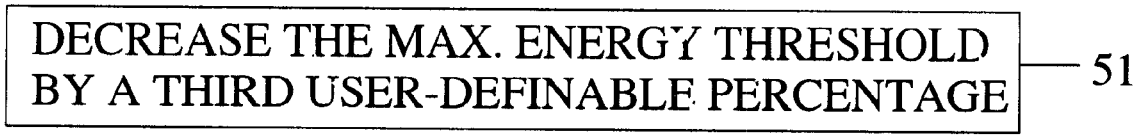
FIG. 5 is a list of a step for adjusting the maximum energy threshold.

In an alternate embodiment, the maximum energy threshold may be modified in a similar, but complementary, fashion as was the minimum energy threshold. FIG. 5 lists the step for modifying the maximum energy threshold.

The step 51 is decreasing the maximum energy threshold by a third user-definable percentage. In the preferred embodiment, the third user-definable percentage is one percent. However, any suitable percentage may be used.

Figure 6:
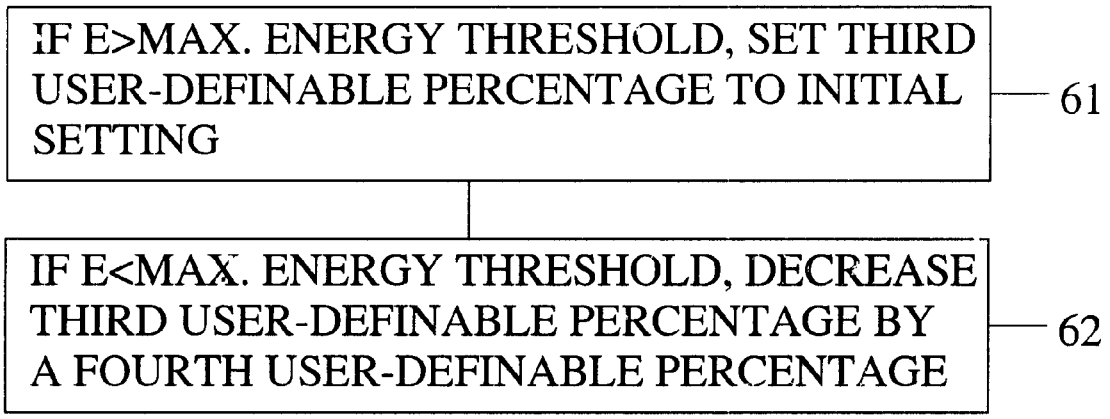
FIG. 6 is a list of additional steps for adjusting the maximum energy threshold.

The step 51 of FIG. 5 may be modified by the steps in FIG. 6.

The first step 61 in FIG. 6 is checking if the energy of the frame is greater than the maximum energy threshold. If so then setting the third user-definable percentage to what the third user-definable percentage was set to in the step 51 of FIG. 5.

The second, and last step 62 is checking the energy of the frame is less than the maximum energy threshold. If so then decreasing the third user-definable percentage by a fourth user-definable percentage. In the preferred embodiment, the fourth user-definable percentage is one-hundredth of a percent. However, any other suitable percentage may be used.

What is claimed is:

1. A method of transmitting speech, comprising the steps of:

a) setting a silence counter to zero;

b) setting a transmit counter to one;

c) setting a blank period counter to zero;

d) receiving a frame of digitized information;

e) determining if the frame contains speech;

f) if the transmit counter is equal to zero and the blank period counter is less than x, where x is a positive integer, then discarding the frame, incrementing the blank period counter by one, and returning to step (d);

g) if the transmit counter is equal to zero, the blank period counter is greater than x−1 and the frame does not contain speech then discarding the frame, incrementing the blank period counter by one, and returning to step (d);

h) if the transmit counter is equal to zero, the blank period counter is greater than x−1, and the frame contains speech then setting the transmit counter to one, setting the blank period counter equal to zero, setting the silence counter equal to zero, encoding the frame, transmitting the encoded frame, and returning to step (d);

i) if the transmit counter is equal to one, the frame does not contain speech, and the silence counter is less than y then encoding the frame, transmitting the encoded frame, incrementing the silence counter by one, and returning to step (d);

j) if the transmit counter is equal to one, the frame does not contain speech, and the silence counter is greater than y+z−2, where y and z are both positive integers, then setting the transmit counter to zero, discarding the frame, encoding a frame containing comfort noise, transmitting the encoded frame containing comfort noise, incrementing the silence counter by one, and returning to step (d);

k) if the transmit counter is equal to one, the frame does not contain speech, and the silence counter is greater than y−1 then discarding the frame, encoding a frame containing comfort noise, transmitting the encoded frame containing comfort noise, incrementing the silence counter by one, and returning to step (d); and l) if the transmit counter is equal to one, the frame contains speech, and the silence counter is less than y+z then encoding the frame, transmitting the encoded frame, setting the silence counter to zero, and returning to step (d).

2. The method of claim 1, wherein the step of discarding the frame, incrementing the blank period counter by one, and returning to step (d) if the transmit counter is equal to zero and the blank period counter is less than x is comprised of the step of discarding the frame, incrementing the blank period counter by one, and returning to step (d) if the transmit counter is equal to zero and the blank period counter is less than 2.

3. The method of claim 1, wherein said step of setting the transmit counter to zero, discarding the frame, encoding a frame containing comfort noise, transmitting the encoded frame containing comfort noise, incrementing the silence counter by one, and returning to step (d) if the transmit counter is equal to one, the frame does not contain speech, and the silence counter is greater than y+z+2 is comprised of the step of setting the transmit counter to zero, discarding the frame, encoding a frame containing comfort noise, transmitting the encoded frame containing comfort noise, incrementing the silence counter by one, and returning to step (d) if the transmit counter is equal to one, the frame does not contain speech, and the silence counter is greater than y+z+2, where y equals 3 and z equals 2.

4. The method of claim 1, wherein said step of determining if the frame contains speech is comprised of the steps of:

a) calculating an energy of the frame as $$E=\sqrt{(A^{HxA)/(FrameSize)}}$$

where A is a vector of the frame, where $A^H$ is a complex conjugate transpose of A, and where FrameSize is a number of samples in the frame;

b) setting a minimum energy threshold;

c) setting a maximum energy threshold;

d) setting a speech threshold as T=(0.07×maximum energy threshold)+(K×minimum energy threshold), where K is a user-definable value;

e) comparing E to T;

f) if E is less than T then concluding that no speech is contained within the frame, other-wise concluding that speech is contained within the frame; and g) increasing the minimum energy threshold by a first user-definable percentage.

5. The method of claim 4, wherein the step of increasing the minimum energy threshold by a first user-definable percentage is comprised of the step of increasing the minimum energy threshold by one percent.

6. The method of claim 5, further including the steps of:

a) if E is less than the minimum energy threshold then setting the first user-definable percentage to what the first user-definable percentage was set to initially; and b) if E is greater than the minimum energy threshold then increasing the first user-definable percentage by a second user-definable percentage.

7. The method of claim 6, wherein the step of if E is greater than the minimum energy threshold then increasing the user-definable percentage by a second user-definable percentage is comprised of the step of if E is greater than the minimum energy threshold then increasing the first user-definable percentage by one-hundredth of a percent.

8. The method of claim 4, further including the step of decreasing the maximum energy threshold by a third user-definable percentage.

9. The method of claim 8, wherein the step of decreasing the maximum energy threshold by a third user-definable percentage is comprised of the step of decreasing the maximum energy threshold by one percent.

10. The method of claim 9, further including the steps of:

a) if E is greater than the maximum energy threshold then setting the third user-definable percentage to what the third user-definable percentage was set to initially; and b) if E is less than the maximum energy threshold then decreasing the third user-definable percentage by a fourth user-definable percentage.

11. The method of claim 10, wherein the step of if E is less than the maximum energy threshold then decreasing the user-definable percentage by a fourth user-definable percentage is comprised of the step of if E is less than the maximum energy threshold then decreasing the third user-definable percentage by one-hundredth of a percent.

12. The method of claim 1, wherein the step of encoding the frame in steps (h), (i), (j), (k), and (l) are each comprised of the step of encoding the frame in Mixed Excitation Linear Prediction (MELP) format.

* * * * *